United States Patent [19]

Henderson

[11] Patent Number: 4,498,208

[45] Date of Patent: Feb. 12, 1985

[54] CHIMNEY CLEANING SYSTEM

[76] Inventor: Henry F. Henderson, 55786 Bivouac Rd., Bend, Oreg. 97702

[21] Appl. No.: 498,632

[22] Filed: May 26, 1983

[51] Int. Cl.[3] ..... F23J 3/00

[52] U.S. Cl. ..... 15/163

[58] Field of Search ..... 15/162, 163, 242, 243, 15/249

[56] References Cited

U.S. PATENT DOCUMENTS

| | | | |
|---|---|---|---|
| 598,672 | 2/1898 | Dunn | 15/163 X |
| 614,874 | 11/1898 | Lefebvre et al. | 15/249 |
| 1,104,030 | 7/1914 | Willat | 15/249 |
| 1,859,166 | 5/1932 | Premro | 15/163 |
| 4,208,757 | 6/1980 | Baugh et al. | 15/249 |
| 4,261,073 | 4/1981 | Lane | 15/163 |

*Primary Examiner*—Peter Feldman

*Attorney, Agent, or Firm*—James D. Givnan, Jr.

[57] ABSTRACT

A system for drawing a wire brush the length of a chimney and including a cap structure which houses the brush when inoperable and further supports a pulley entrained chain. A brush housing is shaped to permit access to both the brush and a chain turnbuckle for servicing purposes. A closure rests in place on the chimney cap structure and may be lifted for access to the chain turnbuckle for adjustment of chain tension.

3 Claims, 4 Drawing Figures

CHIMNEY CLEANING SYSTEM

BACKGROUND OF THE INVENTION

The present invention relates generally to systems for drawing a brush through a chimney or smokestack to periodically clean same.

The prior art discloses various arrangements for propelling cleaning devices along the internal walls of a chimney. Typically, the brush, or brushes, are cable or chain carried with a windlass provided. For the most part such known systems require incorporation into the chimney structure at the time of construction or at least costly radical modification of an existing chimney.

Examples of the prior art systems are found in U.S. Pat. Nos. 598,672; 1,070,662; 1,104,030 and 1,859,166.

SUMMARY OF THE PRESENT INVENTION

The present invention is embodied in a chimney cleaning system readily adaptable to installation within existing chimney, smokestack, stove exhaust ducts and the like.

A brush is adapted for rectilinear travel along the smoke carrying conduit. A chimney cap structure serves to house the brush when not in use. The cap structure defines an area which permits convenient access both to the brush housed therein and to adjustment means to enable periodic brush inspection and tensioning of the brush chain. A closure is slidably mounted over the brush housing to permit convenient brush and chain access.

Important objectives of the present system include the provision of a chimney clearing system adaptable to installation on existing smoke conduits with but minor modification of same; the provision of a chimney cleaning system providing convenient access to adjustable and replaceable components; the provision of a chimney cleaning system of low component cost and one that may be installed by the homeowner.

DETAILED DESCRIPTION OF THE PREFERRED EMBODIMENT

Figure 1:
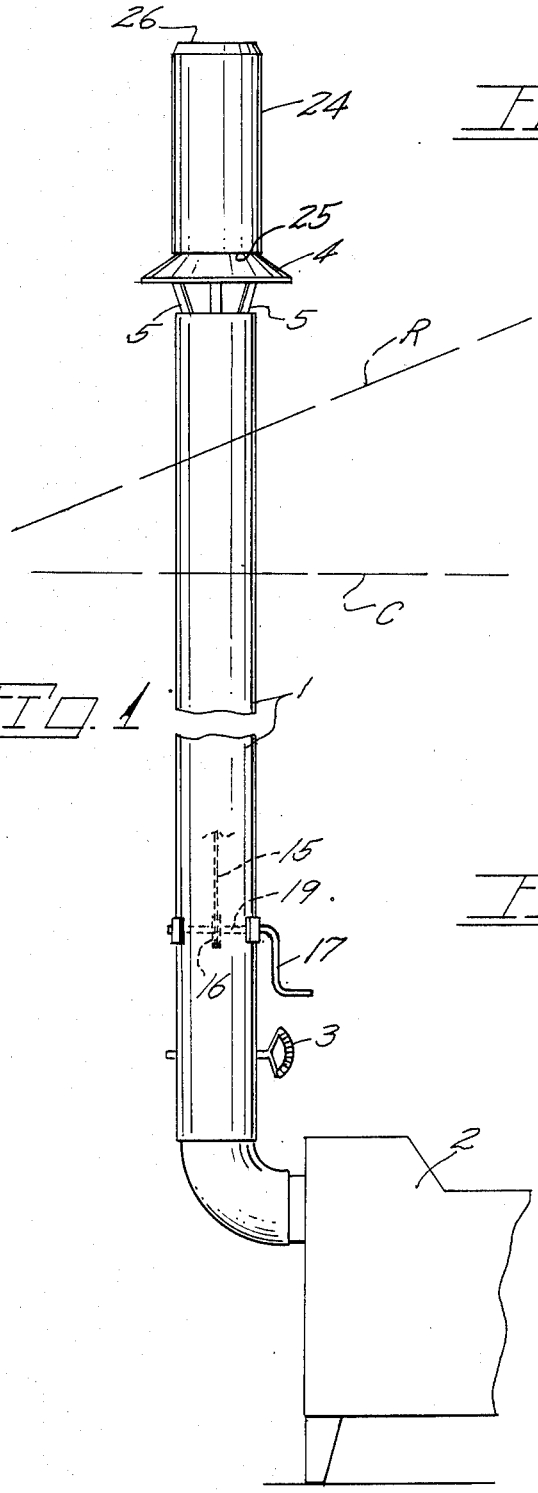
FIG. 1 is a side elevational view of a stove smoke exhaust pipe equipped with the present invention with the pipe sectioned for purposes of illustration.

With continuing attention to the drawings wherein applied reference numerals indicate parts similarly hereinafter identified, the reference numeral 1 indicates a conduit shown as the exhaust pipe of a stove 2 and equipped with a damper 3. The exhaust pipe may be any type of conduit typically used for smoke discharge.

The conduit 1 extends through the ceiling at C and the roof structure at R of a building with suitable insulating components and weather sealing devices not being shown.

The upper end of the conduit is fitted with a base member 4 which may be of conical shape supported by legs 5 secured to the upper conduit end. Base member 4 is truncated with an annular collar at 6. A brush housing at 7 may be of cylindrical shape, open at its ends with its lower end 7A circumposed about collar 6 and secured thereto as by fasteners 8. The open areas between the legs 5 permit the escape of combustion gases and particulate.

Housing 7 is shaped so as to define an open or cut out area 9 extending downwardly from the housing upper end 10. Said opening permits access to a later described brush and chain for maintenance or replacement purposes and does not appreciably weaken the housing. A pair of sleeve type bearings 11 are each suitably secured to the housing exterior wall by curved mounting plates 12. An axle 13 extends through the bearings to receive at its center a pulley wheel 14. Cotter keys 18 retain the axle in place.

A length of chain at 15 is entrained over pulley 14 and about a lower pulley at 16 mounted in smoke conduit 1 near the stove or other appliance. A crank at 17 imparts rotation in a pulley bearing shaft 19 for rectilinear travel of chain 15.

Figure 2:
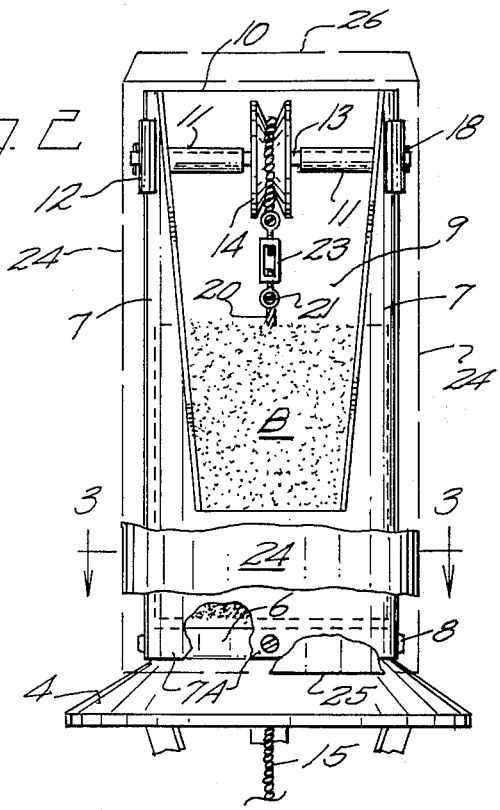
FIG. 2 is an enlarged fragmentary view of the chimney cap structure of the present invention with fragments of a cover broken away for illustrative purposes.
Figure 3:
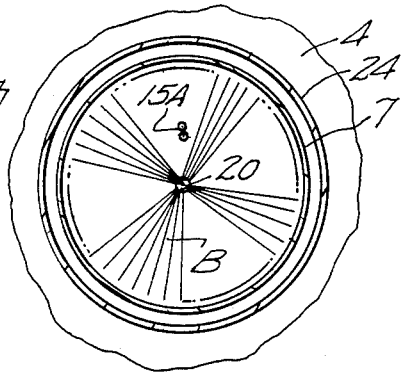
FIG. 3 is a horizontal sectional view taken downwardly along line 3—3 of FIG. 2.
Figure 4:
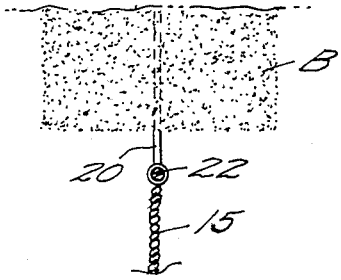
FIG. 4 is a fragmentary side elevational view of the lower portion of a brush of the present invention.

Normally stowed within housing 7 is a wire brush B having a twisted wire core 20 which extends above and below the brush proper and thereat includes eyes for the inserted reception of fasteners at 21 and 22 securing the brush core or stem to one end of a first run of chain at 15 and to one end of turnbuckle adjustment means 23 which is secured at its other end to the remaining end of the chain. The reversed or downwardly extending segment of the chain at 15A passes through the brush bristles which preferably are of stiff wire. Accordingly, the brush may be moved by the chain from its stowed position of FIG. 2 downwardly into the upper end of the exhaust conduit 1 whereat the bristles engage the conduit walls to dislodge the particles adhereing thereto with the particles falling into the stove combustion chamber for burning or removal.

In place over housing 7 is a cylindrical closure 24 which is of somewhat greater size than housing 7 to enable axial placement of the closure thereover with a closure lower rim 25 coming into rested contact with the fixed cap structure. The closure includes a top wall 26 to fully enclose housing 7 from the elements and to provide a dead air space within housing 7 in which the brush B is stored.

As chain tension must be adequate to assure frictional engagement with driving pulley 16 it is important that such tension may be periodically and conveniently adjusted upon lifting of the closure to fully expose the chain turnbuckle.

While I have shown but one embodiment of the invention, it will be apparent to those skilled in the art that the invention may be embodied still otherwise without departing from the spirit and scope of the invention.

Having thus described the invention, what is desired to be secured under a Letters Patent is:

I claim:

1. A chimney cleaning comprising, a brush for contact with the chimney internal walls, an elongate flexible member on which said brush is supported, adjustment means on said flexible member to permit varying the tension of same, a chimney cap structure for disposition above the chimney and including a base member, said base member having legs for supporting said cap structure on the chimney so that spaces are provided between the legs through which the combustion gases and particulate material can pass a brush housing in place on said base member and in which the brush may be stored, said brush housing having a cut out area located adjacent a stored brush and permitting access to said brush and said adjustment means, a detachable closure disposed about said brush housing and defining a dead air space, and pulley means in said brush housing on which the elongate flexible member is entrained, crank and pulley means for installation within the chimney to enable imparting rectilinear travel to said brush for downward entry into and travel along said chimney to clean same whereupon the brush may be retracted upwardly from the chimney by said flexible member for storage in the dead air space within said brush housing.

2. The chimney cleaning system clained in claim 1 wherein said adjustment means permits adjusting the length of said flexible member to assure proper frictional engagement with said pulley means.

3. The chimney cleaning system claimed in claim 1 wherein said closure is of cylindrical shape closed at its upper end and adapted for rested placement on said base member.

* * * * *